US005901857A

United States Patent [19]

Schurman

[11] Patent Number: 5,901,857

[45] Date of Patent: May 11, 1999

[54] BAR SCREEN BAR MOUNT

[75] Inventor: Frank H. Schurman, McMinnville, Oreg.

[73] Assignee: Beloit Technologies, Inc., Wilmington, Del.

[21] Appl. No.: 08/866,464

[22] Filed: May 30, 1997

[51] Int. Cl.[6] ..... B07B 1/46

[52] U.S. Cl. ..... 209/674; 209/395; 403/375

[58] Field of Search ..... 209/393, 394, 209/395, 397, 399, 660, 674; 403/375, 381

[56] References Cited

U.S. PATENT DOCUMENTS

| | | | |
|---|---|---|---|
| 1,606,301 | 11/1926 | Jones . | |
| 2,443,176 | 6/1948 | Banning . | |
| 2,914,177 | 11/1959 | Parks . | |
| 3,300,921 | 1/1967 | Middendorf | 403/375 X |
| 5,305,891 | 4/1994 | Bielagus . | |
| 5,392,930 | 2/1995 | Jones | 209/674 |
| 5,392,931 | 2/1995 | Bielagus . | |
| 5,398,819 | 3/1995 | Cormack et al. | 209/674 |
| 5,476,179 | 12/1995 | Jones et al. . | |
| 5,560,496 | 10/1996 | Lynn . | |

FOREIGN PATENT DOCUMENTS

| | | | |
|---|---|---|---|
| 259963 | 3/1988 | European Pat. Off. . | |
| 3716608 | 12/1987 | Germany . | |
| 5-192642 | 8/1993 | Japan . | |
| 1641469 | 4/1991 | U.S.S.R. | 209/399 |
| 816362 | 7/1959 | United Kingdom . | |
| PCT/SE86/00585 | 12/1986 | WIPO . | |
| PCT/US92/05551 | 1/1993 | WIPO . | |

OTHER PUBLICATIONS

"DynaGaga™ Bar Screen . . . high performance chip thickness screening." Rader Companies.

*Primary Examiner*—Tuan N. Nguyen
*Attorney, Agent, or Firm*—Lathrop & Clark

[57] ABSTRACT

A clamping bar assembly for a bar screen with a plurality of screen bars and in which at least one leg extends downwardly from each bar and a bar support beam extends below the bars. The bar of this invention includes a plurality of spacers positioned on the support beam between neighboring bar legs. The spacers are clamped together with the bar legs by a first flange which is fixed to the support beam and which has an upwardly extending portion, and a portion which extends inwardly above the beam to engage the spacers. A second flange, removably fixed to the beam, has an upwardly extending portion, and a portion which extends inwardly above the beam toward the first flange so that the clamped spacers and bars are restricted from vertical displacement by the first and second flanges.

5 Claims, 1 Drawing Sheet

BAR SCREEN BAR MOUNT

FIELD OF THE INVENTION

The present invention relates to apparatus for screening particulate matter such as wood chips and municipal trash in general and relates to bar screen apparatus in particular.

BACKGROUND OF THE INVENTION

Bar screens have proven particularly valuable in sorting materials which have unequal dimensions. Wire or punched screens are typically used to sort materials of a granular nature in which all three dimensions are approximately equal. However, many classes of objects, including two of particular commercial interest, wood chips and municipal or industrial trash, are not readily amenable to separation by conventional screening processes.

In the manufacture of paper, logs are reduced to wood chips by chipping mechanisms, and the chips are cooked with chemicals at elevated pressures and temperatures to remove lignin. The chipping mechanisms produce chips which vary considerably in size and shape. For the cooking process, which is known as digesting, it is desirable that the chips supplied have a uniform thickness in order to achieve optimal yield and quality. Ideally, the supplied chips will allow production of a pulp which contains a low percentage of undigested and/or overtreated fibers. Thus, a means is needed to separate chips on the basis of thickness rather than any other dimension. Bar screens have proven particularly adept at separating materials based on a single dimension such as thickness.

With the rise in the recycling culture, a strong demand for an apparatus for separating municipal and industrial trash into its constituent components for recycling has developed. Conventional separation systems which utilize rotating screen drums have proved ineffective. Municipal trash which typically contains a certain portion of stranded material as well as sheet-like materials tend to clog the screens. Further, the tumbling action of screens can result in the breakage of components of the municipal waste stream such as glass bottles, thereby increasing the difficulty of recycling them. Bar screens consist of two sets of generally rectangular bars which are joined together in an array of racks. The two sets of bars are interleaved to form a screening bed. The bed consists of the elongated, rectangular bars and the narrow, rectangular spaces between the bars. Material to be sorted is introduced to the surface of the bed and the bars are caused to oscillate so that when one set of bars is going up, the other set is going down. This oscillatory motion tends to tip wood chips or other relatively small planar objects on edge so that those of a given thickness may slide through the gaps between the bars. Alternatively, it has been found when separating office waste paper, that bar screens prove effective in removing extraneous litter from the recovered office paper.

If the limitations of current bar screens could be overcome, the utility of the bar screen, already a valuable tool in the pulp industry and in the recycling industry, would be greatly increased.

One important improvement needed in bar screens is ways to attach thinner bar to the oscillation mechanism which causes the bars to oscillate.

SUMMARY OF THE INVENTION

A clamping bar assembly for a bar screen with plurality of screen bars and in which at least one leg which extends downwardly from each bar and a bar support beam which extends below the bars. The bar the of this invention includes a plurality of spacers positioned on the support beam between neighboring bar legs. The spacers are clamped together with the bar legs by a first flange which is fixed to the support beam and which has an upwardly extending portion, and a portion which extends inwardly above the beam to engage the spacers. A second flange, removably fixed to the beam, has an upwardly extending portion, and a portion which extends inwardly above the beam toward the first flange so that the clamped spacers and bars are restricted from vertical displacement by the first and second flanges.

It is a further feature of the present invention to provide a bar screen which facilitates the use of bars of thinner gauge.

It is yet a further feature of the present invention to provide a bar screen which can process wood chips or industrial or municipal waste.

It is yet another feature of the present invention to provide a bar screen having lower maintenance costs.

Further objects, features, and advantages of the invention will be apparent from the following detailed description when taken in conjunction with the accompanying drawings.

DESCRIPTION OF THE PREFERRED EMBODIMENTS

In bar screens, the bars of each rack of bars are mounted by their depending legs to support beams 130 which ride on eccentric shafts. Whereas conventional bar screens typically have screening bars of half an inch or greater in thickness, bar screens having widths of only a quarter of an inch or less are desirable. For a given bar screen deck area, the use of thinner bars allows more bars to be used and consequently more space between bars. It is the space between bars or the open area of a screen deck which in general governs the rate at which material can be sorted by a given bar screen.

Figure 1:
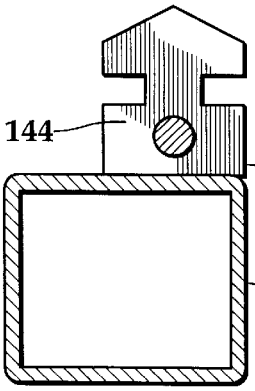
FIG. 1 is a side-elevational view of a retainer employed in a leg retaining bracket taken along lines 1—1 in FIG. 4.
Figure 2:
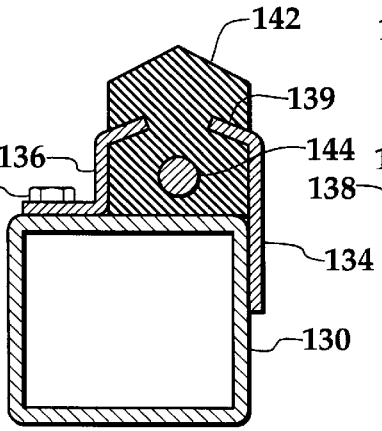
FIG. 2 is a cross-sectional view of a spacer and clamping mechanism of FIG. 4 taken along lines 2—2 in FIG. 4.
Figure 3:
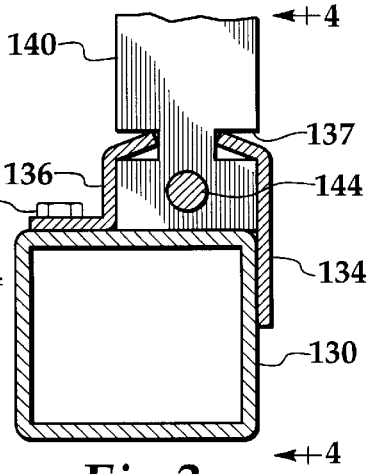
FIG. 3 is a cross-sectional view of a leg retained by the clamp of the alternative embodiment of FIG. 4 taken along lines 3—3 in FIG. 4.
Figure 4:
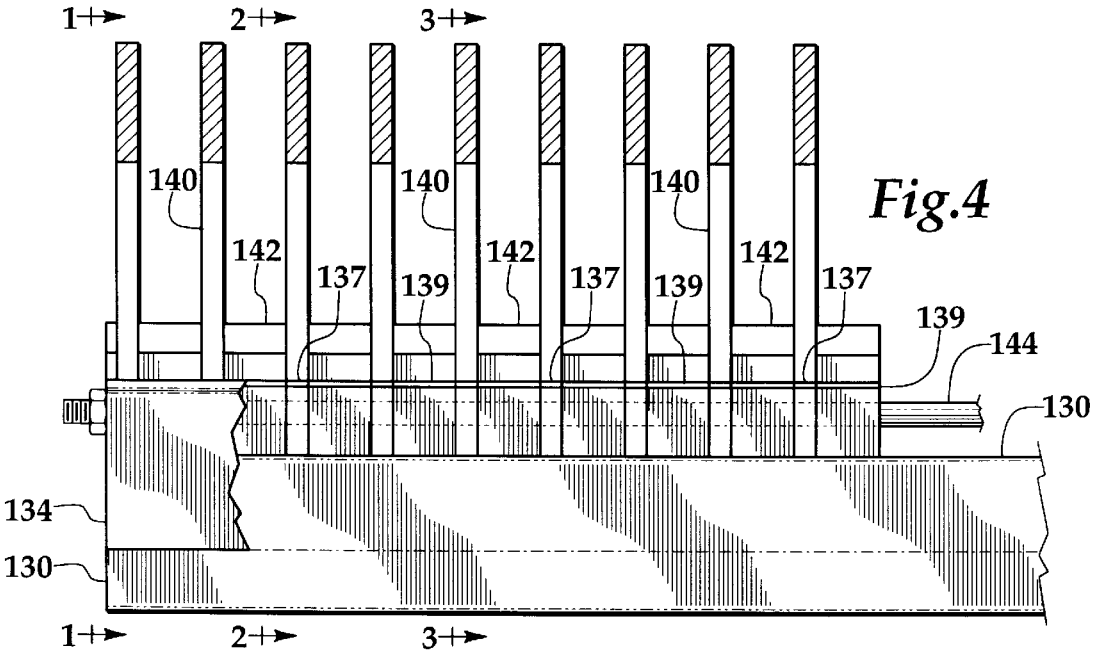
FIG. 4 is a front-elevational view of the alternative leg clamp.

A system for clamping thin gauge bars to a bar support beam 130 is shown in FIGS. 1–4. As shown in FIG. 1, a support beam 130 has an end plate 132 which is welded to the support beam. A fixed bracket flange 134, as shown in FIG. 2, is welded along the side of the support beam 130. A second retaining flange 136 is bolted by bolts 138 to the support beam 130. Spacers 142, shown in FIG. 2, are positioned between neighboring legs 140. The retaining flanges 134, 136 engage within downwardly inclined slots 139 in the spacers 142 and horizontal slots 137 in the bar legs 140. As shown in FIGS. 2 and 3, the screen bar legs 140 are interspersed with spacers 142 along the support beam

130. The entire assembly of end plates 132, legs 140 and spacers 142 is held in place by the clamps 134 and 136, as well as by a threaded rod 144, as shown in FIG. 3. The threaded rod 144 extends through the spacer blocks 142 and the bar legs 140 and the end plates 132.

Figure 5:
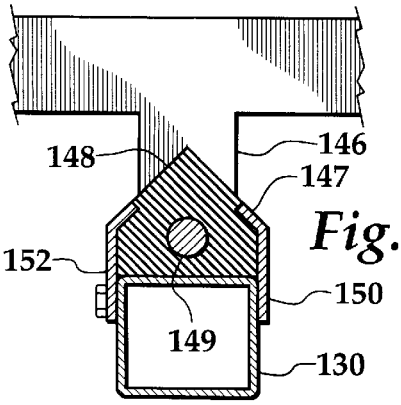
FIG. 5 is yet another embodiment of a leg clamp employable with a bar screen.

As shown in FIG. 5, in a further structure for retaining legs 146 to a bar support beam 130, the bar legs 146 are held between spacers 148. The spacers 148 are wider than the bar legs 146. The bar legs 146 and spacers 148 are compressed together in the cross-machine direction by a threaded rod 149 with tightened nuts (not shown). The rod extends through the legs 146 and the spacers 148. The spacers are held by welded clamps 150 and bolted clamps 152 which have flanges 147, to the leg support beam 130. The clamps 150, 152 extend over the spacers 148 but do not directly engage the bar legs. However, because the spacers are clamped to the bar legs, upward movement of the bar legs is restricted by the clamps 150, 152.

Figure 6:
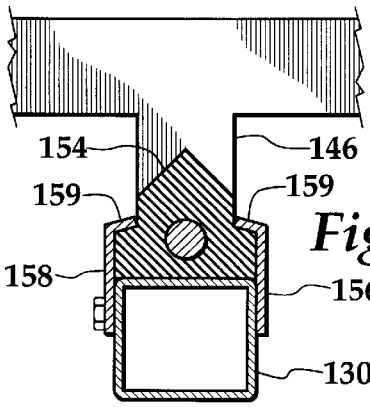
FIG. 6 is a still further embodiment of a leg clamp employable with a bar screen.

Alternatively, as shown in FIG. 6 the clamps 156, 158 may have flanges 159 which are bent more nearly horizontally to engage the spacers 154. The welded clamp 156 and the bolted clamp 158 indirectly engage the legs 146 in a manner similar to the clamp in FIG. 5.

It is understood that the invention is not limited to the particular construction and arrangement of parts herein illustrated and described, but embraces such modified forms thereof as come within the scope of the following claims.

We claim:

1. A bar screen comprising:

a plurality of screen bars;

at least one leg which extends downwardly from each bar, each leg having portions which define a hole;

a bar support beam which extends below the bars;

a plurality of spacers positioned on the support beam between neighboring bar legs, each spacer having portions defining a hole, wherein the spacers are clamped together with the bar legs;

a first flange which is fixed to the support beam and which has an upwardly extending portion, and a portion which extends inwardly above the beam to engage the spacers;

a second flange, removably fixed to the beam, wherein the second flange has an upwardly extending portion, and a portion which extends inwardly above the beam toward the first flange, wherein the clamped spacers and bars are restricted from vertical displacement by the first and second flanges; and a rod extending through the hole in each leg and each spacer to connect the legs and spacers together.

2. The apparatus of claim 1, wherein each spacer has two downwardly inclined slots, and wherein the first flange engages one slot, and the second flange engages the other slot.

3. The apparatus of claim 2 wherein the bar legs have two sidewardly opening slots which engage with the inwardly extending portions of the first flange and the second flange.

4. The apparatus of claim 1 wherein the rod is threaded at one end.

5. The apparatus of claim 1 wherein the second flange is removably attached to the bar support beam by a plurality of bolts.

* * * * *